United States Patent [19]

Winger, James W.

[11] Patent Number: 4,919,330

[45] Date of Patent: Apr. 24, 1990

[54] QUICK RELEASE RAILROAD HIGHWAY CROSSING

[76] Inventor: Winger, James W., 5728 E. Glen Clara Dr., Huntington, W. Va. 25705

[21] Appl. No.: 318,558

[22] Filed: Mar. 3, 1989

[51] Int. Cl.[5] ..... E01B 21/04

[52] U.S. Cl. ..... 238/8; 238/349; 238/351; 238/356; 238/358

[58] Field of Search ..... 238/8, 9, 310, 313, 238/314, 323, 336, 338, 349, 355, 356, 357, 358, 359, 360, 6, 7, 10 C, 12, 13, 316, 321, 323, 327 R, 327 A

[56] References Cited

U.S. PATENT DOCUMENTS

| | | | |
|---|---|---|---|
| 793,847 | 7/1905 | Olds | 238/314 |
| 928,942 | 7/1909 | Cotton et al. | 238/313 |
| 1,057,779 | 4/1913 | Rosencrans et al. | 238/314 |
| 1,069,447 | 8/1913 | Maas et al. | 238/359 |
| 1,084,619 | 1/1914 | Elliott | 238/357 |
| 1,191,025 | 7/1916 | Nelson | 238/314 |
| 1,538,821 | 5/1925 | Kennedy | 238/359 |
| 4,192,459 | 3/1980 | Decaro | 238/310 |
| 4,588,126 | 5/1986 | Foulart | 238/310 |

FOREIGN PATENT DOCUMENTS

| | | | |
|---|---|---|---|
| 0616899 | 7/1935 | Fed. Rep. of Germany | 238/356 |
| 0837264 | 6/1960 | United Kingdom | 238/310 |

*Primary Examiner*—Andres Kashnikow
*Assistant Examiner*—Mark T. Le

[57] ABSTRACT

The railroad highway crossing panel fastening system includes a series of dowel pins, spring clips and hanger/-hanger bars. The dowel pins are inserted or cast into the ends of each crossing panel in a plane parallel to the base of the rail and are positioned from the edge and top of the panels in such a manner as to accomodate varying rail sections. Each dowel pin protrudes beyond the end of the panel a sufficient distance so that when the spring clips or hangers are attached to them and engaged they secure the crossing panels to the track structure enabling highway traffic to pass over the railroad tracks in a safe manner.

5 Claims, 3 Drawing Sheets

QUICK RELEASE RAILROAD HIGHWAY CROSSING

CROSS-REFERENCES TO RELATED APPLICATION

A search of prior related inventions reveals numerous proposals involving clips and hangers of many configurations used to attach railroad rails to wooden or concrete cross-ties, but none used the devices referred to in this application to attach railroad highway crossing panels to the railroad track structure. Those prior patents reviewed pertain only to the attachment of rails, while this application deals with new fasteners to attach highway crossing panels to a railroad track structure.

This proposed invention is an individually sponsored venture and no Federal research or development is involved.

BACKGROUND

This invention relates to the art of attaching or anchoring railroad highway crossing panels to a railroad track structure. Railroad highway crossing panels are either cast using concrete, steel, or rubber or fabricated from individual pieces of wood and laminated or dowelled together forming an integral unit known as a crossing panel. They are make in varying sizes and shapes. Crossing panels are placed adjacent to and between the rails to fill the void between the top of the rail and the top of the cross-ties which exist in a railroad highway crossing. Filling this void permits vehicles, equipment, animals and pedestrians to traverse the railroad tracks safely.

Highway traffic passing over the railroad crossing imposes vertical and lateral forces on the crossing panels. To keep them from loosening and falling out thus endangering highway and train traffic, it is necessary to secure the crossing panels firmly to the railroad track structure.

Traditionally, most wood and rubber crossing panels are attached to the railroad track structure using metal drive spikes or screws which are inserted vertically from the top of the crossing panel, and driven down through the panel and into the railroad cross-ties. Metal drive spikes or screws hold the crossing panels in place very well but when it is necessary to remove the panels to perform repairs to the railroad tracks, they are difficult to remove and are often damaged to the point where they are no longer fit for re-use. Also, removal and re-installation of the crossing panels often results in damage to the integety of the crossing panels thus shortening their expected service life.

The fasteners proposed in this application will simplify the installation, removal and re-application and do so without damage to the fasteners or the crossing panels.

SUMMARY OF INVENTION

Objects of this invention are to provide metal fasteners which attach railroad highway crossing panels to the railroad track structure. The proposed system consists of dowel pins, spring clips, hangers and hanger bars.

Dowel pins are pre-positioned in the ends of the crossing panels in a plane parallel to the base of the rail and at a point measured from the top and sides of the crossing panels which is determined by the size of the rail involved and the thickness of the panels.

Spring clips are manufactured in a "W" shape with a loop on one end and a hook on the other. The loop of the clip is pivoted onto the dowel pin and thence raised upward until the inside portion of the "W" contacts the base of the rail and then is raised further to a height where the hook end of the spring clip is slipped over the dowel pin in the panel on the opposite side of the rail thus providing adaquate hold down force for both of the crossing panels adjacent to the rail.

Hangers are made with a loop at the top which fits over the dowel pins and a set of tongs at the bottom which grasps the hanger bar providing adaquate hold down force for the crossing panel involved. The loop end of the hanger is pivoted onto the dowel pin and the hanger lowered between the cross-ties where the tongs in the relaxed position surround the hanger bar. The collar of the hanger is then forced downward which causes the tongs to meet the side slope of the hanger bar, slip down along the slope until they engage the tips of the hanger bar and then slip into the final position at the base of the hanger bar thus securing the crossing panel to the cross-ties.

Both fasteners provide the necessary force to safely secure the crossing panels to the track structure. They further simplify the application, removal and re-application of a crossing so equipped. All of the fastening components can be applied, removed and re-applied as railroad work activities demand without any loss of strength or permanent deformation. Also, initial application, removal and re-application can be performed without any structural damage to the crossing panel materials thus insuring full service life for all of the crossing components.

DESCRIPTION OF THE PREFERRED EMBODIMENT(S)

Figure 1:
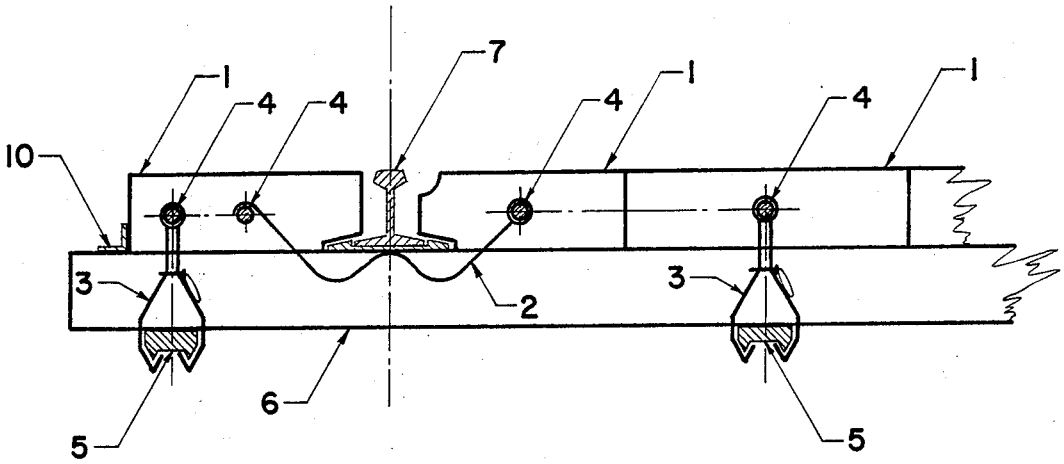
FIG. 1 is an end view of a half section of a typical railroad highway crossing illustrating the anchoring system with the clip and hangers in the engaged position.

Reffering now to FIG. 1 there is illustrated the railroad highway crossing panel fastening system according to this invention. The crossing panels ,1, are drawn downward by two type of fasteners, namely, spring clips ,2, and hangers ,3, causing the crossing panels to bear on cross-tie ,6. Restraining member ,10, is attached to the cross-tie ,6, to prohibit lateral movement of the crossing panels ,1.

Those panels ,1, that are adjacent to the railroad rail ,7, and exist at the ends of the crossing are held down using spring clip ,2, The loop end of spring clip ,2, is pivoted onto dowel pin ,4, and the hook end placed under the rail and lifted upward until the internal bend of the spring clip contacts the base of the rail ,7, thence the hook is positioned up and over the dowel pin ,4, in panel ,1, on the opposite side of the rail,7.

Hanger ,3, is used to hold down crossing panels that are not adjacent to the rail ,7. The loop end of the hanger ,3, is pivoted onto the dowel pin ,4, and the body of hanger ,3, is lowered between adjacent cross-ties ,6. Hanger bar ,5, is placed under and at right angles to the centerline of cross-tie ,6, so that when the hanger collar on hanger ,3, is lowered, the tongs of hanger ,3, will contact the lips of hanger bar ,5, and slip up and over them engaging hanger bar ,5.

Figure 2:
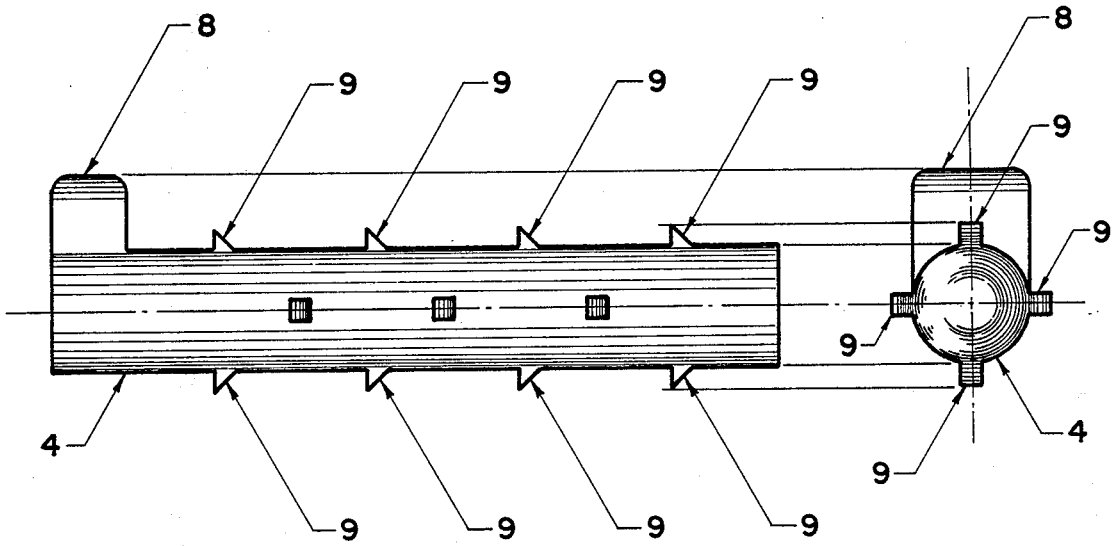
FIG. 2 is a side and end view of the dowel pin showing the hooked projection at one end and the anti-back-out barbs along the perimeter.

In FIG. 2, the dowel pin ,4, is shown. This appurtenance is designed with a projection ,8, at one end to accomodate the loop of both clips and hangers, and to assure that the said loops do not vibrate or otherwise work their way off the end of dowel pin ,4. The perimeter of the dowel pin ,4, is designed with barbs ,9, which resist the backout of dowel pin ,4, after they have been driven or cast in a crossing panel.

Figure 3:
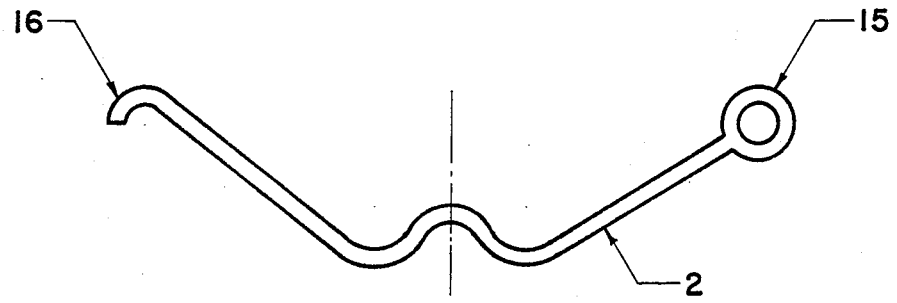
FIG. 3 is a side view of a clip in the relaxed position showing the loop at one end and the hook at the other.

FIG. 3, shows the spring clip ,2, in a relaxed position. The clip consists of a "W" shaped body constructed of spring steel with a loop ,15, on one end and a hook ,16, on the other end.

Figure 4:
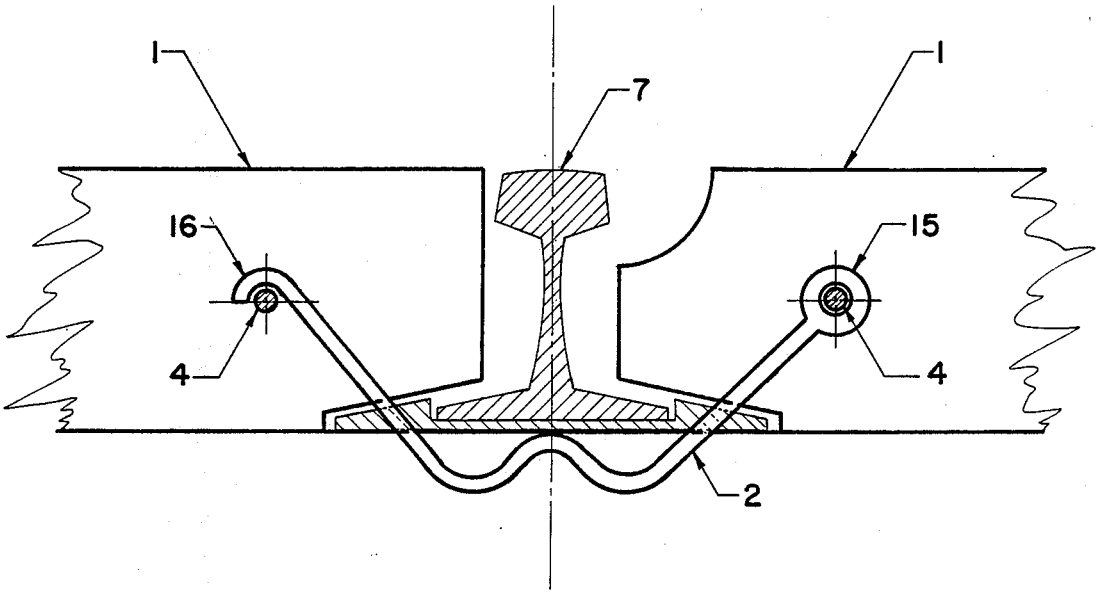
FIG. 4 is a section view of a clip application showing the crossing panel attached to the rail by the clip in the engaged position.

FIG. 4, shows a section view of a spring clip ,2, in the engaged position. Loop ,15, is pivoted onto dowel pin ,4, and clip ,2, is then placed under rail ,7. Spring clip ,2 is then raised upward so that the internal bend contacts the base of rail ,7, and the hook end ,16, is forced up and over dowel pin ,4, securing crossing panel ,1.

Figure 5:
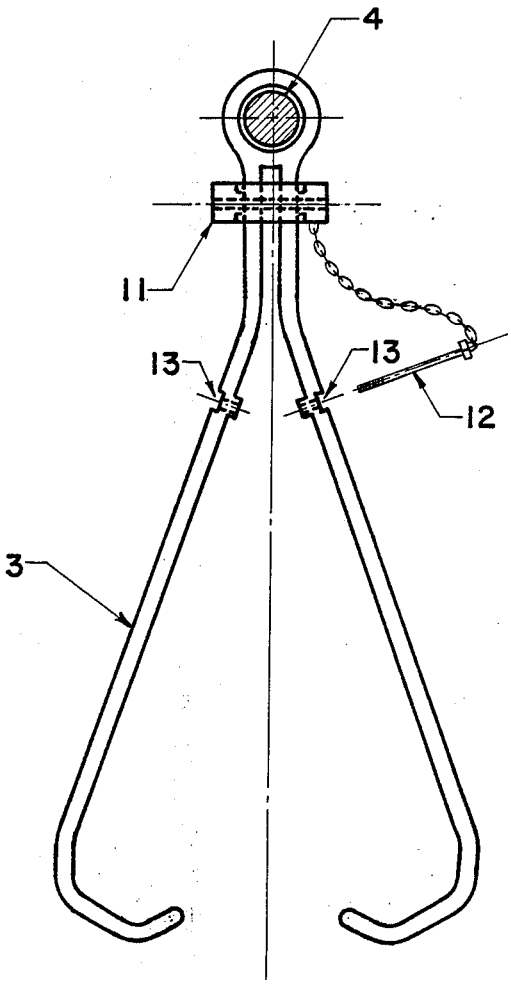
FIG. 5 is a side view of a hanger showing it in the relaxed position.

FIG. 5, shows hanger ,3, in a relaxed position. It further depicts hanger collar ,11, hanger collar safety pin ,12, and hanger notch ,13. The function and purpose of these features are further explained in FIG. 6.

Figure 6:
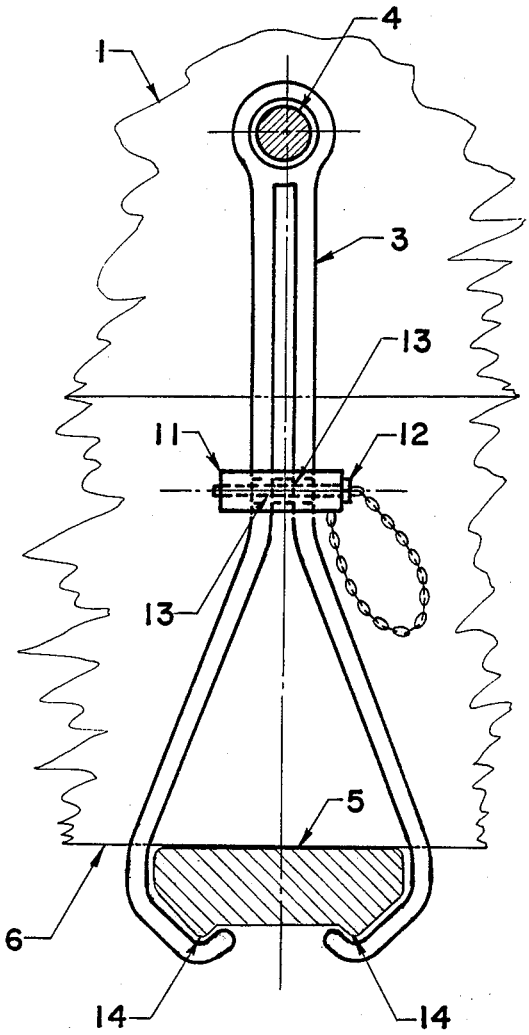
FIG. 6 is a side view of a hanger showing it in the engaged position

FIG. 6, shows a hanger ,3, in the engaged position. The loop of hanger ,3, is pivoted onto dowel pin ,4, and hanger ,3, is lowered between cross-tie ,6, until it meets hanger bar ,5, then hanger collar. 11, is forced downward along the tongs of hanger ,3, until hanger collar 11, engages hanger notch , 13, which forces the tongs of hanger ,3, up and over the lip ,14, of hanger bar ,5, and secures the crossing panel, 1. After the hanger ,3, engages hanger bar ,5, hanger collar safety pin ,12, is inserted into the hole in hanger collar, 11, to insure that hanger collar ,11, does not work free allowing the tongs of hanger ,3, to release and disengage from hanger bar ,5.

Figure 7:
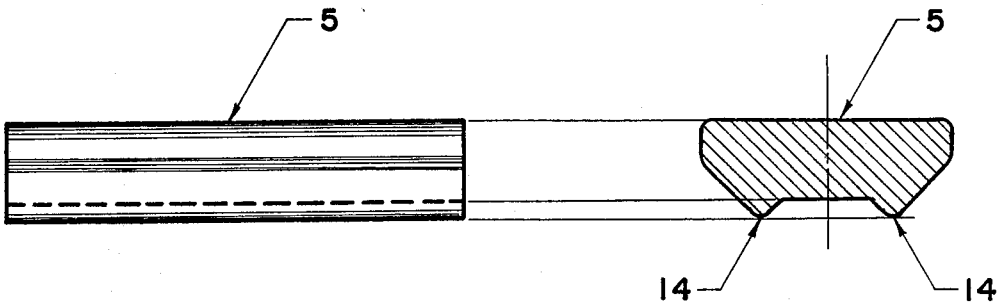
FIG. 7 is a side and end view of a hanger bar.

FIG. 7, shows a side and end view of hanger bar ,5. The drawing also shows the hanger bar lip ,14, which acts as a stop to retain the tongs of hanger ,3, after they have engaged hanger bar ,5.

Having thus defined my invention in the detail and particularity required by the Patent Laws, what is desired protected by Letters Patent is set forth in the following claims:

What is claimed:

1. A railroad highway crossing panel fastening system in combination with a track assembly that includes parallel rails supported by cross-ties positioned transversely under said rails, elongated hanger bars positioned transversely below the cross-ties and highway crossing panels positioned on top of the cross-ties in a manner to establish a substantially continuous horizontal surface at substantially the level of the upper-most surface of the rails in an installed position, said crossing panels being secured on top of the cross-ties by said highway crossing panel fastening system, which fastening system includes:

at least one substantially W-shaped spring clip having one end pivotally connected to a first pin on one of said crossing panel, the opposite end hooked to a second pin on one of said crossing panel by means of a hook formed on said opposite end, and a mid-section between said ends and traversing underneath an associate rail;

a hanger having an upper end portion pivotally connected to a third pin on one of the crossing panels and a lower end portion hooked onto one of said hanger bars by hook means formed at said lower end portion of the hanger.

2. The combination according to claim 1, wherein each of said hanger bars includes lips formed on one of its faces for preventing the hook means of the hanger from becoming disengaging with the hanger bars.

3. The combination according to claim 1, wherein each of said hangers is in the form of a tong including two arms interconnected via said upper end portion of said hanger and each of said arms includes said hook means at said lower end portion of the hanger.

4. The combination according to claim 3, wherein the mid-part of one of said arms includes a hole aligned with a hole on the other of said arms so as to receive a safety pin that keeps said arms from moving apart.

5. The combination according to claim 1, wherein the mid-section of each of said spring clips is bent upward and exerts a spring force against the bottom an associate rail while the other two ends of the spring clips are fixed relative to associate crossing panels.

* * * * *